US010011990B2

(12) United States Patent
Collins

(10) Patent No.: US 10,011,990 B2
(45) Date of Patent: Jul. 3, 2018

(54) LAMINATED AIR CIRCULATION BOARD

(71) Applicant: P. Michael Collins, Cincinnati, OH (US)

(72) Inventor: P. Michael Collins, Cincinnati, OH (US)

(73) Assignee: P. Michael Collins, Cincinnati, OH (US)

( * ) Notice: Subject to any disclaimer, the term of this patent is extended or adjusted under 35 U.S.C. 154(b) by 0 days.

(21) Appl. No.: 15/359,655

(22) Filed: Nov. 23, 2016

(65) Prior Publication Data

US 2017/0073964 A1 Mar. 16, 2017

Related U.S. Application Data

(63) Continuation-in-part of application No. 15/213,700, filed on Jul. 19, 2016.

(60) Provisional application No. 62/194,322, filed on Jul. 20, 2015.

(51) Int. Cl.

| | |
|---|---|
| ***E04B 1/70*** | (2006.01) |
| ***E04B 2/44*** | (2006.01) |
| ***E04C 2/04*** | (2006.01) |
| ***E04C 2/32*** | (2006.01) |

(Continued)

(52) U.S. Cl.

CPC ..... *E04C 2/3405* (2013.01); *E04B 1/7076* (2013.01); *E04B 2/44* (2013.01); *E04C 2/044* (2013.01); *E04C 2/06* (2013.01); *E04C 2/32* (2013.01); *E04C 2002/3427* (2013.01)

(58) Field of Classification Search

CPC ..... E04B 1/70; E04B 1/7038; E04B 1/7069; E04B 1/7076; E04B 1/7645; E04B 2/02; E04B 2/44; E04B 2/48; Y10T 428/24661; E04C 2/044; E04C 2/049; E04C 2/06; E04C 2/32; E04C 2/3405; E04C 2002/3405; E04C 2002/3411; E04C 2002/3416; E04C 2002/3427; E04C 2002/3472; E04F 15/182; E04F 15/185; E02D 31/02; E02D 31/025

USPC ..... 52/302.1, 302.3, 309.17, 363, 385, 386, 52/408, 413, 450, 453, 789.1; 428/174, 428/178

See application file for complete search history.

(56) References Cited

U.S. PATENT DOCUMENTS 3,845,593 A * 11/1974 Zen ..... E04C 2/049 52/144
4,000,595 A 1/1977 Fortescue
4,446,661 A 5/1984 Jonsson et al.

(Continued)

*Primary Examiner* — Ryan D Kwiecinski
(74) *Attorney, Agent, or Firm* — Wood Herron & Evans LLP

(57) ABSTRACT

A laminated board is secured to the inner wall of a cavity wall construction to establish a defined spacing between the inner and outer walls and prevent excess mortar from bridging to the inner wall. The laminated board has a series of spaced sockets into which fasteners may project into the face of the inner wall or framing thereof to secure the outer wall. The board is installed prior to the construction of the outer wall and establishes a minimum spacing or gap between the walls based upon the thickness of the board. The outer wall is constructed immediately adjacent to the outer face of the laminated board. The board is impervious and eliminates bridging by the mortar, eliminates transfer of bulk water from the exterior finish to the inner wall and provides an air conduit to exhaust even the minimal amounts of vapor that will occur in the cavity.

18 Claims, 5 Drawing Sheets

(51) Int. Cl.
*E04C 2/34* (2006.01)
*E04C 2/06* (2006.01)

(56) References Cited

U.S. PATENT DOCUMENTS

| | | | | | |
|---|---|---|---|---|---|
| 4,517,782 | A * | 5/1985 | Shamszadeh | E04B 5/40 | 428/319.1 |
| 4,852,320 | A | 8/1989 | Ballantyne | | |
| 4,916,875 | A | 4/1990 | Kashiwagi | | |
| 4,943,185 | A * | 7/1990 | McGuckin | E02B 11/00 | 210/170.07 |
| 4,955,172 | A | 9/1990 | Pierson | | |
| 5,230,189 | A | 7/1993 | Sourlis | | |
| 5,343,661 | A | 9/1994 | Sourlis | | |
| 5,347,781 | A | 9/1994 | Hanlon | | |
| 5,598,673 | A | 2/1997 | Atkins | | |
| 5,775,039 | A * | 7/1998 | McPherson | E04B 1/7023 | 52/169.5 |
| 5,860,259 | A | 1/1999 | Laska | | |
| 5,937,594 | A | 8/1999 | Sourlis | | |
| 6,000,194 | A * | 12/1999 | Nakamura | B28B 19/003 | 52/783.17 |
| 6,023,892 | A | 2/2000 | Sourlis | | |
| RE36,676 | E | 5/2000 | Sourlis | | |
| 6,256,955 | B1 | 7/2001 | Lolley et al. | | |
| 6,298,620 | B1 * | 10/2001 | Hatzinikolas | E04B 1/70 | 52/302.1 |
| 6,355,333 | B1 * | 3/2002 | Waggoner | E04B 1/62 | 428/174 |
| 6,410,118 | B1 | 6/2002 | Reicherts et al. | | |
| 6,594,965 | B2 | 7/2003 | Coulton | | |
| 6,684,579 | B2 | 2/2004 | Brunson et al. | | |
| 7,421,826 | B2 | 9/2008 | Collins et al. | | |
| 8,291,668 | B2 * | 10/2012 | Iske | E21D 11/381 | 52/414 |
| 8,516,760 | B2 * | 8/2013 | Julton | E04D 11/002 | 52/309.8 |
| 2002/0124507 | A1 | 9/2002 | Atkins | | |
| 2004/0003558 | A1 * | 1/2004 | Collins | E04B 1/4178 | 52/302.1 |
| 2006/0201092 | A1 * | 9/2006 | Saathoff | E04F 13/00 | 52/385 |
| 2006/0277854 | A1 * | 12/2006 | Egan | E04B 1/70 | 52/302.3 |
| 2008/0260993 | A1 * | 10/2008 | Koester | E04B 1/70 | 428/131 |
| 2011/0023397 | A1 * | 2/2011 | Charvoz | E04C 2/044 | 52/414 |
| 2012/0183744 | A1 * | 7/2012 | Keene | B32B 5/26 | 428/175 |
| 2012/0247040 | A1 * | 10/2012 | Buoni | E04B 1/70 | 52/302.1 |

* cited by examiner

LAMINATED AIR CIRCULATION BOARD

This is a continuation in part of U.S. patent application Ser. No. 15/213,700 filed Jul. 19, 2016, which claimed the benefit of U.S. Provisional Patent Application Ser. No. 62/194,322, filed Jul. 20, 2015 and each of these prior applications is hereby incorporated by reference in its entirety.

BACKGROUND OF THE INVENTION

This invention relates to exterior finishes on buildings, utilizing lath as part of the exterior finish system and, more particularly, to an impervious device used in construction of those exterior finish systems that establishes drainage and air circulation pathways which effectively mitigate wet conditions, which often lead to mold growth.

Stucco and thin veneer brick or stone are popular exterior finish systems. Such wall assemblies often include inner and outer walls. The inner structural wall is typically constructed from concrete masonry units (CMU), wood or steel studs with an interior surface of drywall or the like. The outer face of CMU inner walls typically includes a flashed air and moisture barrier layer which manages air and moisture movement over the face of the inner wall. The outer face of a wood or steel framed inner wall typically includes a layer of sheathing such as plywood, particle board or the like, that is fastened to the framing. Commonly, an air and moisture barrier covers the sheathing material which manages air and moisture movement over the face of that inner wall. The outer wall over both CMU and wood or steel framed inner walls is generally constructed of a cement or modified-cement base layer of the exterior finish system which is applied over a metal or fiberglass flat or self-furring lath. These lath products are permeable and do not stop inbound water movement. During construction of the cement or modified-cement base coat layer in non-cavity wall assemblies, the base coat material will come into permanent contact with the inner wall. This contact is known as bridging and is a permanent viaduct for transporting water from the outer wall to the inner wall.

One potentially catastrophic result of bridging between the inner and outer walls is trapped moisture in that layer of the wall assembly by interfering with the free flow of water which in turn and over time reduces or negates the beneficial physical properties of the air and moisture protection. Furthermore, wetting can saturate insulations which negate their thermal properties.

Benefits of cavity wall construction are known to the building industry. With a minimum ⅜-inch clearance between the inner and outer walls, cavities provide reliable pathways for drainage and air circulation, both characteristics being beneficial for dry and healthy wall assemblies.

Currently there is commercially available netting and fabric cavity protection devices that claim to establish drainage and ventilation spaces, as located between the inner and outer wall components. Although theses nettings and fabrics may perform to a degree of their claim, they aren't as efficient and predictable as a dedicated and defined ⅜-inch deep pathway, which dimension is defined by building sciences as a minimum depth requirement for a cavity.

Furthermore, nettings and fabrics do not offer enough deflective structural support to the exterior finish. To the contrary, they are so weak as to be a detriment to exterior finish performance when exposed to the stresses of repetitive wind and impact related deflection.

Furthermore, netting and fabric cavity protection devices are permeable and allow rates of bulk and vapor transmission to move from being stored in, or leaking through the outer wall to the inner wall.

SUMMARY OF THE INVENTION

The above described and other shortcomings in the prior art have been addressed by this invention which in one embodiment is a laminated air circulation board which includes a non-permeable dimpled panel with a lath laminate layer that is secured to the face of the inner wall to establish a defined spacing between the face of the inner wall and inward side of the outer wall and prevents cement or modified-cement base coat material applied to the device from bridging to the inner wall. The dimpled panel has a series of spaced depressions, sockets or sockets into which fasteners may project into the face of an inner CMU wall or into wood or steel framing studs of the inner wall to permanently secure the board. The laminated board is installed prior to the construction of the cement or modified-cement base coat layer of the exterior finish and establishes a minimum spacing or gap between the walls based upon the depth of the sockets. The exterior finish outer layer may be constructed over the base coat layer.

The sockets of the panel create dedicated spaces for drainage and air circulation thereby minimizing the conditions that promote mold growth in the cavity between the two walls. The laminated board eliminates bridging, as described above, and provides an air conduit to exhaust even the minimal amounts of vapor that will occur in the cavity. A self-sealing tape may be applied to the interface between the inner wall and cupped depressions so that when fasteners penetrate the board, the small annular space created by the fastener shank is sealed from leaking. The bottom edge of the board may be spaced about six to eight inches above the exterior grade or one to three inches above an intersecting deck or roof to allow for inlet and outlet movement of air. The socketed panel portion of the laminated board may be extruded or formed plastic, metal, or other non-biodegradable material.

As a result, this invention provides a durable, impervious and reliable solution to the above-described problems in the prior art and one which can be easily and efficiently installed with known cavity wall construction techniques.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 6:
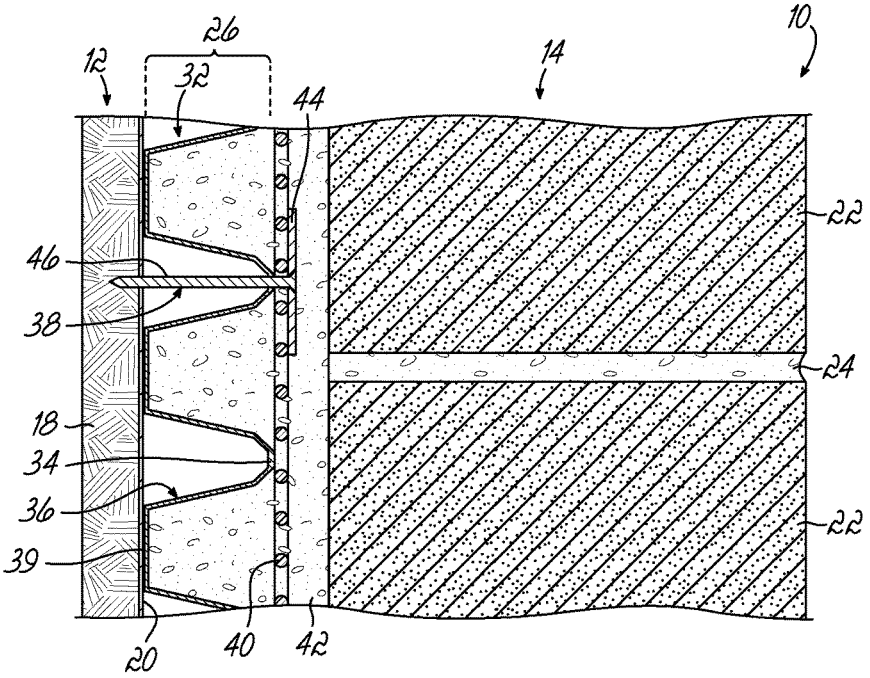
FIG. 6 is a cross-sectional view taken along line 6-6 in FIG. 4 of one embodiment of a laminated air circulation board according to this invention.

One embodiment of this invention is used in a cavity wall 10 construction environment. As shown in U.S. Pat. No. 7,421,826, which is hereby incorporated by reference in its entirety, and FIG. 6 herein, brick veneer/cavity walls 10 are made with inner and outer walls 12, 14. The inner wall 12 is typically constructed from CMU, wood or steel studs 16 with an interior surface of drywall or the like. The outer face of the inner wall 12 typically includes a layer of sheathing 18 such as plywood, particle board or the like, that is nailed to the studs 16. Commonly, a weather resistant or air barrier material 20 covers the sheathing material 18 to limit moisture from progressing through the inner wall 12. The outer wall 14 is generally constructed of masonry materials 22, such as bricks, stone or the like, that are held together by mortar 24. Common practice in many municipal building codes requires a space of at least ⅜ to one inch forming a cavity 26 between the inner and outer walls 12, 14. The reason for this cavity 26 is to provide a space for water to drain and air to circulate, thereby keeping the cavity 26 dry. When the cavity 26 is dry and air can circulate, the conditions for mold growth are minimized. Anchors (not shown) often span the cavity 26 and are embedded into the mortar 24 securing the outer wall 14 to the inner wall 12.

Frequently during the construction of a building with a brick veneer/cavity wall 10, the mortar 24 and other debris can and does escape from the back face of the outer wall 14 to contact the vapor barrier 20 on the inner wall 12. Excess mortar that spans the cavity 26 between the two walls is referred to as "bridging".

One potentially catastrophic result of excess mortar 24 bridging between the inner and outer walls 12, 14 is that the installed barrier 20 on the inner wall 12 may be torn or damaged during construction thereby allowing moisture that travels along the "bridge" to become trapped between the remaining barrier 20 and the sheathing 18 of the inner wall 12. Over time, such moisture conditions will generate mold growth which, if left unchecked would attack the biodegradable structure and/or sheathing material causing them to fail, create a health hazard to occupants of the structure and/or present an expensive repair.

Figure 5:
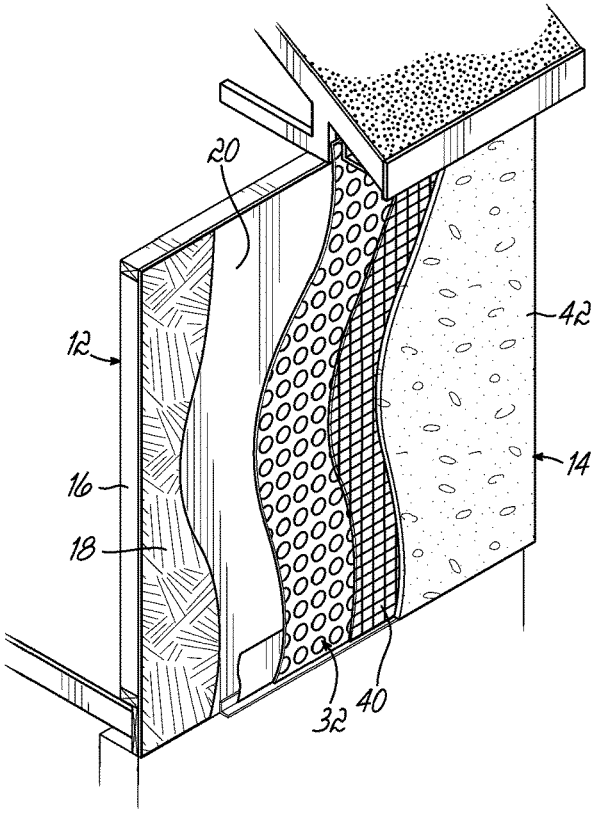
FIG. 5 is a perspective view with various components cut away of one embodiment of an inner wall according to this invention.

According to this invention, a laminated board 32 is secured to the inner wall 12 to establish a defined spacing or cavity 26 between the inner and outer walls 12, 14 and prevent excess mortar 24 from bridging to the inner wall 12. The board 32 includes a panel 34 which has a series of spaced sockets, dimples, cups or depressions 36 into which fasteners 38 may project into the studs/framing 16 of the inner wall 12 to secure the outer wall 14. The board 32 is installed prior to the construction of the outer wall 14 and establishes a minimum spacing or gap 26 between the walls 12, 14 based upon the thickness of the board 32. The outer wall 14 will be constructed immediately adjacent to the outer face of the board 32. One embodiment of the inner wall is shown in FIG. 5 according to this invention.

In one embodiment, the board 32 is a laminate of a panel 34 and a fiberglass lath 40. The board 32 is called Lath Cavity Counter Wall (LCCW) or Rain Screen Lath and is a laminate of a panel 34, molded sockets 36 and an open weave fiberglass lath 40. Each socket 36 has an open end 37 at the face of the panel 34 and a depth defined by the closed end 39 of the socket. The board 32 could also be a laminate of a panel 34 and a metal lath 40. The board 32 is designed to be installed over a flashed air barrier wall 12 with the closed end 39 of the sheet molded sockets 36 in contact with the air barrier 20 on the inner wall surface and with the lath side of the laminate board 32 facing outward, to receive a cement or modified-cement base-scratch coat 42 and subsequent cement stucco, modified-cement stucco, or adhered manufactured stone or brick exterior wall 14. The board 32 of the wall assembly thereby establishes dedicated pathways between the walls 12 and 14 for water and air to move freely for drainage and drying.

The molded socket panel 34 is an impervious weather barrier that stops capillary transfer of water from the cement or modified-cement base-scratch coat layer 42 to the structural wall 12. Combined with the dedicated space for water drainage (incidental or bulk) and dedicated space for air circulation, the LCCW 32 enhances structural wall 12 performance by keeping it dry.

In addition to draining and drying the face of the air barrier 20, thermal properties of the wall assembly 10 are predictably enhanced, as much as can be possible, by separating the inner and outer walls 12, 14.

Air barrier systems manage air movement. Cavity drainage systems like the LCCW 32 manage water movement. Combined, these systems maximize overall exterior wall performance and durability.

Where the exterior wall 14 has multiple combinations of exterior finishes, (by example any combination of unit masonry veneer, stone veneer, hard siding, thin brick on metal panels, or cement or modified-cement base-scratch coat based finishes) a common, non-compressible and water impervious cavity space material can be employed. This can be achieved by using LCCW 32 along with a cavity counter wall for unit masonry veneer or stone veneer finishes, and cavity counter wall furring strips for hard siding, thin brick or girts for metal panel finishes. These products have the same socket dimensions and will transition from one to another in a straight forward manner.

LCCW 32 is the central product for constructing either a simple rain screen or a Pressure Equalized Rain Screen (PERS) under exterior finishes 14 that have a cement or modified-cement base-scratch coat underlying structure.

LCCW 32 is designed to be installed, with or without outbound rigid insulation, over CMU, precast concrete walls, CIP concrete walls, and sheathed walls on wood or steel framing.

LCCW 32 is not designed for use over the stated substrates when they are covered with outbound mineral wool, as mineral wool is not rigid enough to be a supporting substrate. One LCCW 32 embodiment is a thermoformed polymeric panel 34 laminated to an open weave fiberglass lath 40. The polymeric core may be up to 100% post-consumer recycled material.

The laminate board 32 of this invention is an impervious weather barrier for inbound driven moisture from the exterior wall 14. There is little or no likelihood of moving stored or bulk water from the exterior wall 14 to the inner wall 12.

The laminate board 32 establishes a dedicated and predetermined ⅜ inch or greater space 26 for water drainage. A dedicated and open cavity 26 is the fastest way to evacuate water. It is common for the dew point to occur on cooler surfaces found in the cavity space. That is the subject water in play for this feature and it is important to drain and dry that water.

The laminate board 32 establishes a dedicated and predetermined ⅜ inch or greater space 26 for circulation of air, which fosters efficient drying. Dew point water that condenses on the face of the air barrier or interior side of the sheet molded socket panel 34 has the ability to dry quickly, via circulating air.

The laminate board 32 establishes a thermal break between the cement or modified-cement base-scratch coat and structural wall 12. It is expected that less than 15% of the sheet molded socket panel 34 will be in contact with the structural wall and of that area only the sockets with fasteners will be in full and compressed contact with the structural wall 12.

Management of wind pressure and thermal drive (both are pressures on the wall system) by venting the bottom and top of wall sections and then restricting lateral air movement with sidewalls in the cavity 26 takes the pressure off of the air barrier system 20 by effectively neutralizing inbound and outbound pressure via opposing vents located along the top and bottom of wall sections. For vapor permeable air barrier walls, outbound moving vapor meets this cavity 26 where its pressure drive is neutralized, water condenses and the draining and drying capabilities of the free space of the cavity come into play.

In one embodiment of this invention the sockets 36 are filled with cement or modified-cement base-scratch coat material to add a calculable depth to the specified outbound thickness for an overall stronger layer. Socket filling does more than embed the lath 40. Socket filling assures "complete encapsulation" of the lath 40 at the socket opening. Thereby it is stronger and resists impact better than other configurations.

In section view the profile of the base-scratch coat 42 can be said to be on a pedestal formed by the individual sockets 36. These pedestals or sockets 36 act like small trusses in the counter wall and add strength without adding a lot of additional weight. More strength per pound of material is a desirable characteristic for wall assemblies 10.

The laminate board 32 is UV stable after application of the cement or modified-cement base-scratch coat 42 and simplifies construction scheduling.

Installation of the LCCW 32 is not temperature dependent. Because it is laminated, two steps (installation of sheet molded socket panel 34, then installation of lath 40), are reduced to one step. Both features simplify scheduling and installation.

As part of a wall assembly, the LCCW 32 is expected to outlast the cement or modified-cement base-scratch coat 42 thereby making it and the wall 10 more durable and sustainable than walls not using the LCCW 32.

"Bounce" experienced during application of traditional cement or modified-cement base-scratch coat applications over metal or fiberglass lath systems is insignificant during application of the base-scratch coat onto the LCCW 32. A stable and substantial substrate is beneficial to the overall predictability of a base-scratch coat installation and subsequent performance of the exterior finish. Less bounce is achieved with the LCCW 32 of this invention Qualified installers appreciate the straight forward installation and simplicity of the design. Quality contractors like using quality products and specified systems that are easy to install and that last a long time. Designers can be confident knowing they have specified a fully functioning system.

Installation

An installer marks framed and sheathed inner walls 12 to identify the location of the framing members or studs 16. Use the markings to guide the vertical positioning of columns of sockets 36 over the identified framing studs 16. Taking the time to mark and grid the wall 12 will increase the speed and accuracy of LCCW 32 and fastener 38 placement.

Where outbound rigid insulation is part of a framed and sheathed wall design transfer the framing marks to the face of the insulation before aligning columns of sockets 36 for fastening.

When outbound rigid insulation is part of a sheathed and framed wall assembly, installation of the rigid insulation should be executed by the contractor installing the LCCW 32 to take advantage of the visibility of the initial wall markings. Precast, CIP concrete and CMU walls do not require alignment markings for columns of sockets. As applies, related accessories are installed prior to and during installation of the LCCW 32.

Spray adhesive (not shown) may be applied to the receiving substrate 12. A spray adhesive may be compatible with the receiving air barrier or rigid insulation.

The LCCW 32 is then positioned over the spray adhesive with the fiberglass lath 40 facing outward.

In framed and sheathed wall applications, the center line of each column of sockets 36 is aligned with the vertical grid markings associated with the studs 16.

The LCCW 32 may be pressed onto the adhesive to hold it in place until fasteners 38 are secured.

In framed and sheathed wall applications, permanently secure, as described below, before adding a higher lift to the wall 10.

Figure 4:
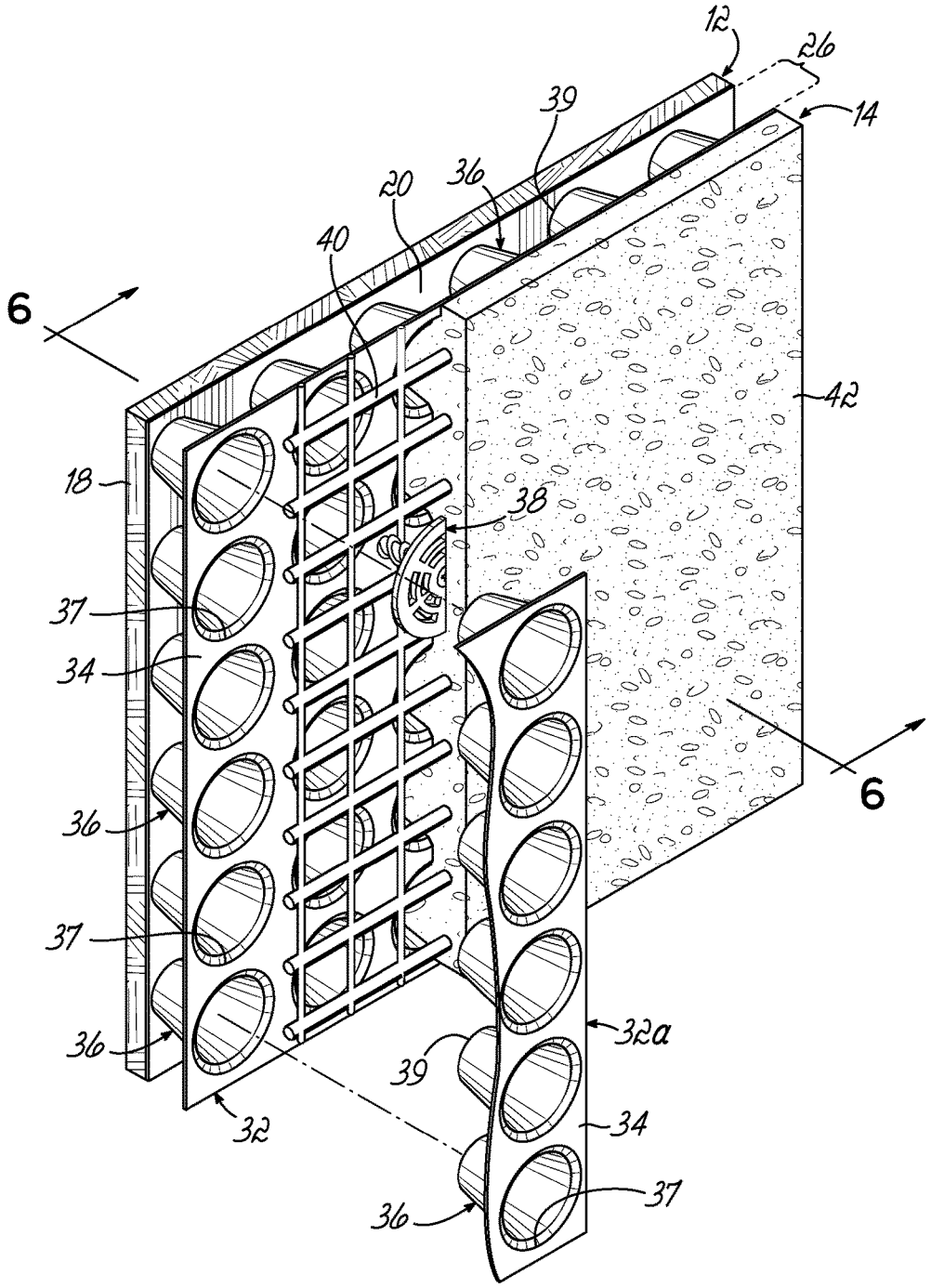
FIG. 4 is a view of the outer face of an inner wall covered with the laminated circulation board and cement stucco according to one embodiment of this invention.
Figure 4A:
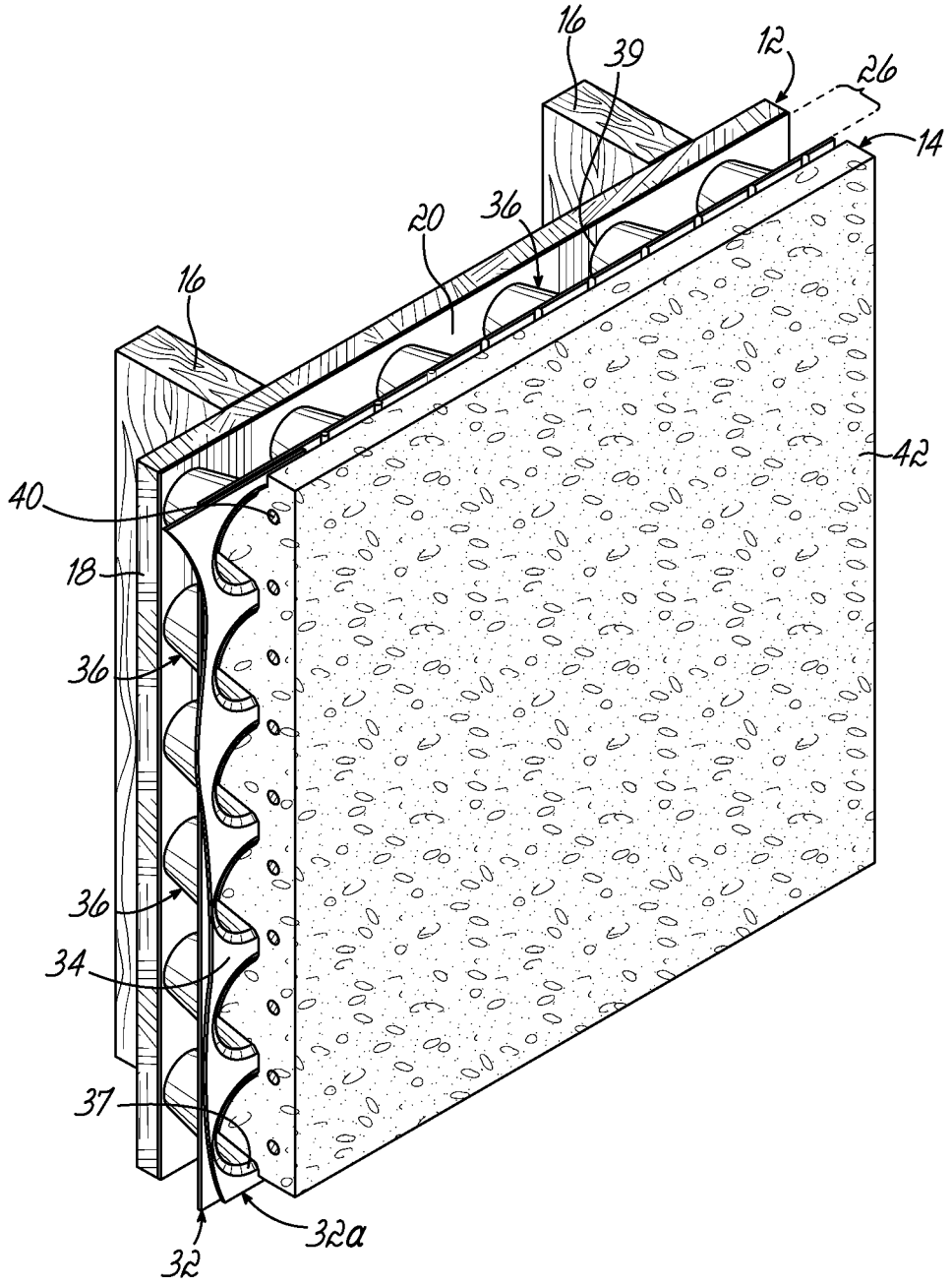
FIG. 4A is a view similar to FIG. 4 with sockets of the outboard edge of each board nested and with all of the sockets filled with cement.

As work proceeds from board 32 to board 32*a*, nesting the sockets 36 of the outboard edge most column of sockets on each board 32, 32*a* may be used at continuing edges and ends as shown in FIG. 4.

For attachment of LCCW 32 to steel stud framing, a corrosion resistant, Phillips or star head self-tapping screw fastener 38, with a minimum 5⁄16" diameter bugle head 44 and with a shaft 46 that will penetrate steel framing a minimum of ⅜" could be used.

For attachment of LCCW 32 to wood framing, with a minimum specific gravity of 0.42, use a corrosion resistant, Phillips or star head wood screw fastener 38 with a minimum 5⁄16" diameter bugle head 44 and with a shaft 46 that will penetrate wood framing a minimum of 1¼".

Figure 1:
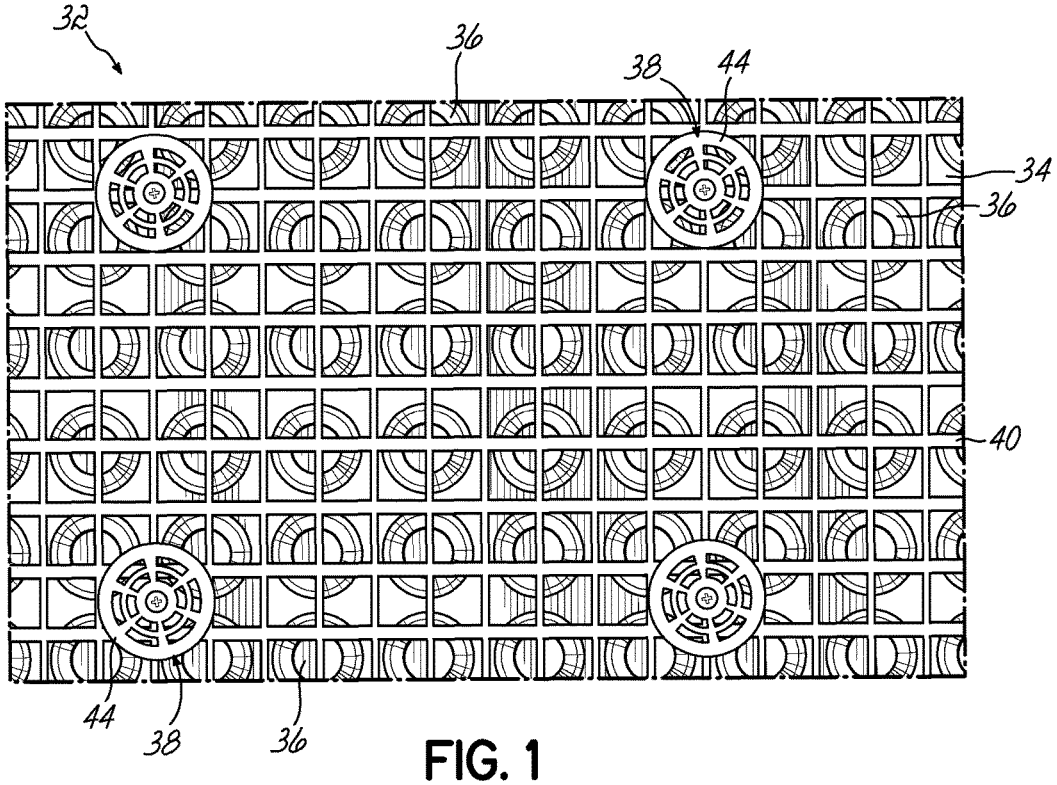
FIG. 1 is a view of a laminated air circulation board of one embodiment of this invention.
Figure 2:
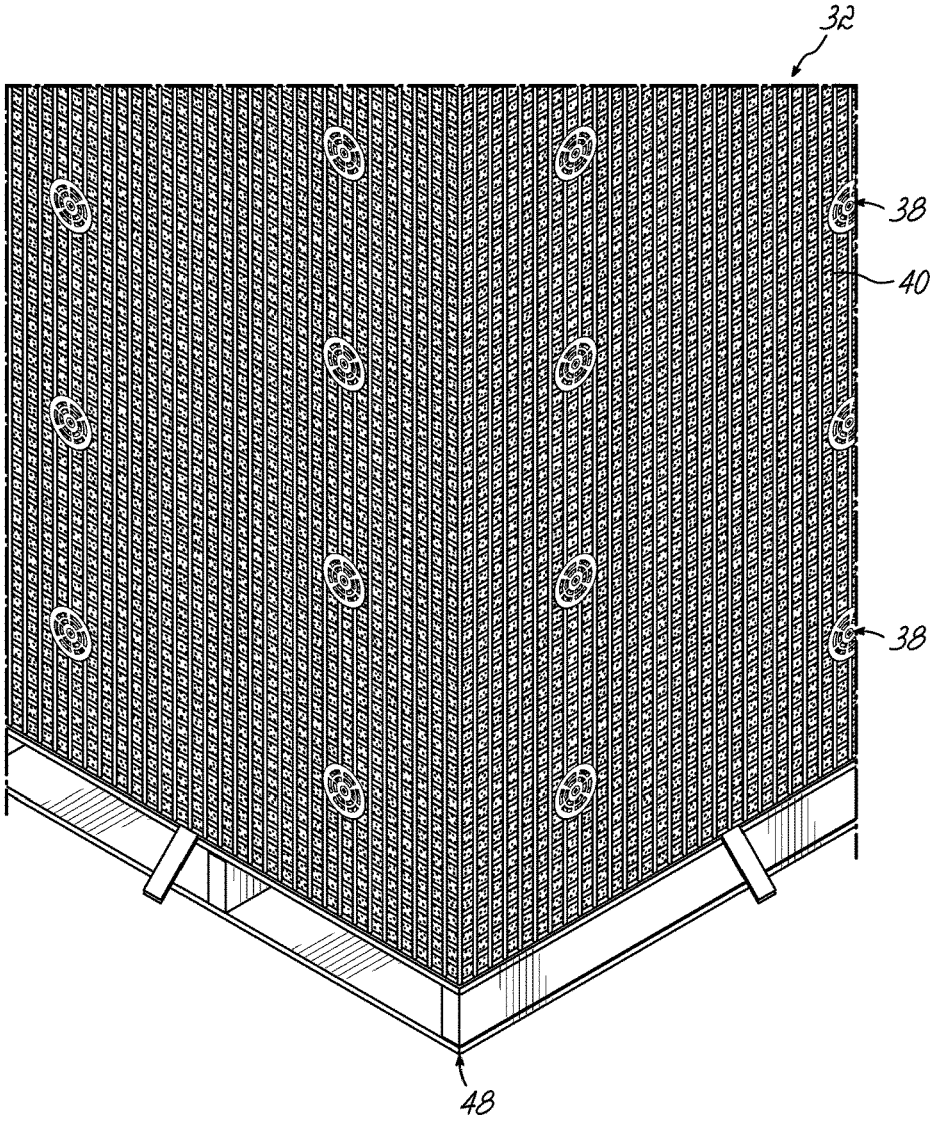
FIG. 2 is a view of the laminated air circulation board of FIG. 1 showing installation on a corner wall section.
Figure 3:
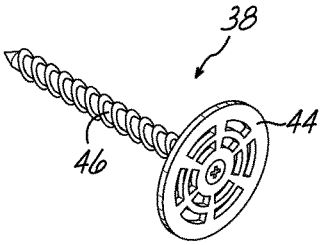
FIG. 3 is a perspective view of one embodiment of a fastener according to this invention.

For attachment of LCCW 32 into the face of a CMU, pre-cast concrete panel or CIP concrete wall select a corrosion resistant, Phillips or star head masonry screw fastener 38 with a minimum 5⁄16" diameter head 44 and with a shaft 46 that will penetrate to a minimum depth of 1" and not more than a maximum depth of 1¾".

Where the LCCW 32 encounters an inside or outside corner (FIG. 2), trim the intersecting ends of the board 32 to flush with the corner 48 and then for inside corners install a fiberglass tape (not shown) to bridge the end gap and for outside corners install either fiberglass lath tape or an expanded metal lath corner (not shown) to close the end gap.

Proceed with the application of cement or modified-cement base-scratch coat 42. Apply the base-scratch coat 42 with enough pressure to completely fill the sockets 36 and then to the specified thickness recommended by the cement stucco, modified-cement stucco, or adhered manufactured stone or brick manufacturer. Impermeability of the polymeric core of the LCCW 32 may retard the loss of moisture from the base-scratch coat 42 thereby extending the curing time.

Proceed with the selected stucco finish coat(s) or adhered manufactured stone or brick following the manufacturer's installation information.

CCWS Weep Vents

CCWS Weep-Vents are 2-inch wide strips of sheet molded drainage. Sockets in the drainage core are 0.25-inches deep.

The pieces are designed for repetitive placement over and along through-wall-flashings located at and along the bottom of Masonry Veneer or Lath Cavity Counter-Wall Sheets at approximately 8-inch spacing. In that position they will connect the dedicated cavity space with the face of the exterior finish for draining and venting the cavity. Maximum results for managing water and air movement are achieved when CCWS Weep-Vents are used in conjunction with CCWS Top-Vents, secured at and along the top of cavity Masonry Veneer or Lath Counter-Wall Sheets at the same approximate spacing.

Installation (1) Cut the initial length of a CCWS Weep-Vent to extend from the structural wall to beyond where the face of the exterior finish will be. (2) Place each piece with the closed-end of the sockets interfacing with the face of the through-wall-flashing and then nest them onto sockets on the cavity side of the Masonry Veneer or Lath Cavity Counter-Wall Sheet. Position as many CCWS Weep-Vents as possible to align with the framing/studs/blocking and permanently secure them at the same time as the Masonry Veneer or Lath Cavity Counter-Wall Sheets. Do not use fasteners to secure CCWS Weep-Vents that are not in alignment with the stud/framing/blocking: when that condition arises, use hand pressure to nest the sockets and wait for the exterior finish to secure the placement. (3) After installation of the exterior finish, trim extended CCWS Weep Vent material flush with the face of the exterior finish.

CCWS Top-Vents

CCWS Top-Vents are 2-inch wide strips of sheet molded drain with a fabric layer attached to the bottom of the sockets. Sockets in the drainage core are 0.25-inches deep. The pieces are designed for repetitive placement at and along the top edge of Masonry or Lath Cavity Counter-Wall Sheets at approximately 8-inch spacing. In that position they will connect the dedicated cavity space with the face of the exterior finish. They are a companion product to the CCWS Weep-Vent when building a PERS wall. CCWS Top-Vents are not needed where the top of a wall section will be connected to a vented eave/soffit or connected to a vented and unconditioned space.

Installation (1) Position CCWS Top-Vents so that the fabric side of the piece will be facing the structural/backing wall with a minimum of three rows of sockets nested onto the back of the Masonry Veneer or Lath Cavity Counter-Wall Sheets. This will position the fabric layer of the piece to become the top side of the piece as it is bent to an outward and downward slope and then covered by the exterior finish materials. When venting the top of a wall that will be capped with metal (i.e. chimney or parapet etc.), size the length of CCWS Top-Vents to bend over the top of the uncapped wall finish and to end at a position that will be below where the bottom edge of the metal cap will be. After the cap is placed, trim the CCWS Top-Vents to flush with the bottom edge of the metal. Include the 0.25-inch depth of the CCWS Top-Vent when calculating the metal cap dimensions. (2) After installation of the exterior finish, trim extending CCWS Top Vent material to flush with the face of the exterior finish.

Multi-Perf™ WM, as disclosed in U.S. Pat. No. 8,011,145 (incorporated herein by reference) a closed cell compressible sponge laminated to a stiff polypropylene mounting flange that has a pressure sensitive adhesive on the wall mounting side of the flange that is protected by a removable release paper. The outer edge of the sponge is perforated along its length in 8-⅛-inch increments.

Multi-Perf WM is designed to have the mounting flange adhered, sealed or fastened to a structural/backing wall, at locations indicated in the construction documents/specifications. The sponge section of the piece is designed to be embedded in the exterior finish, as the exterior finish is applied. Embedded segments of sponge are designed to be removed incrementally to facilitate; finishing of the exterior finish at the joint by the exterior finish contractor and to further facilitate depth dimensioning by the sealant contractor for application of either, a bond-breaker-tape and sealant or, a backer rod and sealant.

The assurance of using Multi-Perf WM is: (1) The joint space will not be compromised or contaminated by the exterior finish material; (2) the width of the sealant joint will be pre-determined and executed as such; (3) the width of the sealant joint will be more predictably uniform; (4) as sponge segments are removed, they will expose virgin surfaces for finishing of the edge of the exterior finish and sealant adhesion respectively; (5) cavity-space debris will have no way of unintentionally compromising the intended compressible space when the device covers an area outbound from the structural/backing wall to the face of the exterior finish; (6) movement joint construction, and Pressure Equalized Rain Screen compartmentalization and sectioning can be standardized.

Installation

Multi-Perf WM is to be installed by the exterior finish contractor in league and coordinated with information supplied by the sealant contractor regarding the target width and depth of the joint needed for either, of a bond-breaker tape and sealant or, installation of a backer rod and sealant. Construct a width of joint dimension greater than ¼-inch by adhering Multi-Perf SA thicknesses of either ⅛-inch or ¼-inch to achieve the target width dimension.

If, the SAF deforms while being peeled back or does not peel back at all then, priming will not be required. If, the SAF does not deform while being peeled back then, priming will be required. Use 3M Super 77 Spray Adhesive or equal as a primer. In both the primed and unprimed conditions "best practice" calls for rolling the SS SAF with a hand-held, hard-surfaced roller which will optimize adhesion.

When Multi-Perf WM will be used as a cavity wall compartment sidewall there will be conditions where using a double V metal shape (double V's are used for expansion in exterior finishes involving lath) is a more practical method of sectioning a cavity. When that is the case, use a 2-piece double V, as found in our listing for Metal and Membrane Through Wall Flashings parts, and seal both flanges of the lower installed piece to the wall with minimum 3-inch wide pieces of York 304 or 316 SS SAF. Where a Cavity Counter-Wall System is part of the exterior wall assembly, install Multi-Perf WM before installing the Cavity Counter-Wall sheets. (1) Center and adhere the selected part over and onto the structural/backing wall at the locations indicated in the construction drawings or construction specifications. (2) Where applicable, install Cavity Counter-Wall System sheets to abut the sponge. (3) Construct the exterior finish to interface directly with, but not to compress, each side of the sponge. (4) Remove as minimally as possible enough sponge segments to expose the area needed to finish the exterior finish at and along each side of the joint. (5) Remind the sealant contractor that the sponge is perforated in ⅛-inch segments for removal as needed to establish the required depth needed for application of the sealant. (6) Center and adhere the selected part over and onto the structural/backing wall at the location(s) indicated in the construction drawings or construction specifications. (7) Use an appropriate width of York 304 or 316 SS SAF (304 for inland areas and 316 for coastal areas) to cover the bracket side of the sponge from inward (+ or −) ½-inch from where the interior side of the exterior finish will be, across the wall leg of the flange and then onto a minimum of 2-inches of the structural/backing wall. Use another piece of the selected York SAF to cover the other side of the sponge from the same opposing and outward edge location and then onto a minimum of 2-inches of the structural/backing wall. (Note: Where the compartment will begin at a ledge or end at the top of an over intersecting wall cantilever or floor, size the SS SAF to cover onto those beginning and ending planes and then cut and flare the SS SAF material to fit onto and be adhered to those planes.) (8) Where applicable, install Cavity Counter-Wall System sheets to abut the sponge. (9) Construct the exterior finish to interface directly with, but not to compress, each side of the sponge. (10) Remove as minimally as possible enough sponge segments to expose the area needed to finish the exterior finish at and along each side of the joint. (11) Remind the sealant contractor that the sponge is perforated in ⅛-inch segments for removal as needed to establish the required depth needed for application of the sealant.

Multi-Perf™ SA is a rectangular shaped compressible closed cell sponge. One side of the sponge has a pressure sensitive adhesive covered with a protective release film. Each sponge piece is perforated along its length in ⅛-inch increments.

Multi-Perf SA is primarily designed to be surface applied along fenestration frames, around wall penetration sidewalls, under shelf angles before an exterior finish is applied, and where dissimilar exterior finish materials interface. Secondarily and just as important are applications where materials other than the three listed will interface. The perforations in the sponge create segments that can be removed incrementally and independently to achieve a desired sealant joint depth after the exterior finish has been installed to the sidewall of the sponge.

The assurance of using Multi-Perf SA is: (1) there will be a defined compressible space between the interfacing and dissimilar substrates; (2) the joint space cannot be compromised or contaminated by the exterior finish material; (3) the width of the sealant joint can be pre-determined and executed as such; (4) the width of the sealant joint will be uniform; (5) as segments are removed they will expose virgin surfaces for finishing the exterior finish and sealant adhesion respectively; (6) cavity-space debris has no way of compromising the compressible space when the sponge covers outward continuously from the face of the structural wall to the back side of the sealant and; (7) reduction of "brick binding" pressure on a fenestration jamb frames. Brick bind on a fenestration jamb frame is a deforming pressure commonly found when clay masonry veneer expands or a wall creeps against a non-compressible material.

Installation

Multi-Perf SA is to be installed by the exterior finish contractor in league and coordinated with information supplied by the sealant contractor regarding the target width of the joint and the target depth of the sealant joint. Width of sponge determines the width of the sealant joint. For sponge thickness greater than ¼-inch, laminate additional ⅛-inch or ¼-inch layers together to achieve the target thickness. Depth of the sealant joint determines how much of the sponge can be adhered to the frame or sidewall (how much release film to take off). (1) Select a width of sponge to use from the list at the end of this document. (2) Determine the area along fenestration frames, around wall penetration sidewall and under shelf angles to cover. Covering the frame or sidewall with sponge from the face of the structural wall to at or beyond where the face of the exterior finish may be accomplished. (3) Tear along the segment perforations to make a piece that best covers the area determined in Step 2. (4) Remove release paper only from segments that will remain in the joint after the sealant is applied. The remaining segments should still have release paper in place so they are not adhered to the substrate and can be removed enough to either, install a bond-breaker-tape and sealant or, install a backer rod and sealant. (5) While installing the exterior finish, incrementally remove segments to expose the edge of the exterior finish surface for finishing.

I claim:

1. A cavity wall construction comprising:

an inner wall;

an outer wall facing an outer face of the inner wall and being generally parallel to and spaced from the inner wall to define a cavity therebetween;

a laminated board positioned between the inner and outer walls;

the laminated board comprising a panel having a plurality of sockets in the panel, each of the plurality of sockets having an opening defined at a generally planar face of the panel and a depth defined by a closed end;

a plurality of fasteners each coupled to the generally planar face of the laminated board and the inner wall and spaced from each of the plurality of sockets;

a lath layer on the generally planar face of the panel, the plurality of fasteners each having an enlarged head securing the lath layer to the generally planar face; and at least a coating of cement covering the generally planar face of the panel and the lath layer juxtaposed to the outer wall.

2. The cavity wall construction of claim 1 further comprising:

a sheathing board attached to a plurality of studs forming a part of the inner wall; and wherein selected ones of the plurality of sockets are aligned with one of the plurality of studs.

3. The cavity wall construction of claim 1 further comprising:

a barrier substantially covering the outer face of the inner wall to inhibit moisture from penetrating into the inner wall.

4. The cavity wall construction of claim 1 wherein each of the plurality of sockets is identical to each other of the plurality of sockets and the plurality of sockets are evenly spaced and arranged on the panel.

5. The cavity wall construction of claim 1 wherein the coating of cement covers the generally planar face of the panel and fills each of the plurality of sockets.

6. The cavity wall construction of claim 1 wherein the closed end of each of the plurality of sockets on the panel is juxtaposed to the outer face of the inner wall.

7. The cavity wall construction of claim 1 wherein the laminated board further comprises a plurality of the panels, wherein each panel is of the plurality of panels is coupled to an adjacent panel of the plurality of panels by nesting selected sockets of the plurality of sockets which are proximate to a terminal edge of each adjacent panel of the plurality of panels with each other.

8. The cavity wall construction of claim 1 wherein less than 15% of the panel is in contact with the inner wall.

9. A cavity wall construction comprising:

an inner wall having a sheathing board attached to a plurality of studs forming a part of the inner wall;

a barrier substantially covering an outer face of the inner wall to inhibit moisture from penetrating into the inner wall;

an outer wall facing an outer face of the inner wall and being generally parallel to and spaced from the inner wall to define a cavity therebetween;

a laminated board positioned between the inner and outer walls;

the laminated board comprising a panel having a plurality of sockets in the panel, each of the plurality of sockets having an opening defined at a generally planar face of the panel and a depth defined by a closed end;

wherein each of the plurality of sockets is identical to each other of the plurality of sockets and the plurality of sockets are evenly spaced and arranged on the panel;

a plurality of fasteners each coupled to the generally planar face of the laminated board and the inner wall and spaced from each of the plurality of sockets;

a lath layer on the generally planar face of the panel, the plurality of fasteners each having an enlarged head securing the lath layer to the generally planar face; and at least a coating of cement covering the generally planar face of the panel and the lath layer juxtaposed to the outer wall, wherein the coating of cement fills at least some of the plurality of sockets;

wherein the closed end of each of the plurality of sockets on the panel is juxtaposed to the barrier on the outer face of the inner wall and selected ones of the plurality of sockets are aligned with selected ones of the plurality of studs.

10. The cavity wall construction of claim 9 wherein the laminated board further comprises a plurality of the panels, wherein each panel is coupled to an adjacent panel by nesting selected sockets of the plurality of sockets which are proximate to a terminal edge of each adjacent panel with each other.

11. A combination including a laminated board for use in a cavity wall construction having an inner wall and an outer wall facing an outer face of the inner wall and being generally parallel to and spaced from the inner wall to define a cavity therebetween, the laminated board being positioned between the inner and outer walls, the combination comprising:

a panel having a plurality of sockets in the panel, each socket having an opening defined at a generally planar face of the panel and a depth defined by a closed end;

a plurality of fasteners each coupled to the generally planar face of the laminated board and the inner wall and spaced from each of the plurality of sockets;

a lath layer on the generally planar face of the panel, the plurality of fasteners each having an enlarged head securing the lath layer to the generally planar face; and at least a coating of cement covering the generally planar face of the panel and the lath layer juxtaposed to the outer wall.

12. The combination of claim 11 wherein each of the plurality of sockets is identical to each other of the plurality of sockets and arranged on the panel.

13. The combination of claim 11 wherein the coating of cement covers the generally planar face of the panel and fills each of the plurality of sockets.

14. The combination of claim 11 wherein the closed end of each of the plurality of sockets on the panel is juxtaposed to the outer face of the inner wall.

15. The combination of claim 14 wherein the inner wall further comprises a sheathing board attached to a plurality of studs forming a part of the inner wall, wherein selected ones of the plurality of sockets are aligned with selected ones of the plurality of studs.

16. The combination of claim 11 further comprising:

a plurality of the panels, wherein each panel of the plurality of panels is coupled to an adjacent panel of the plurality of panels by nesting selected sockets of the plurality of sockets which are proximate to a terminal edge of each adjacent panel of the plurality of panels with each other.

17. A combination including a laminated board for use in a cavity wall construction having an inner wall and an outer wall facing an outer face of the inner wall and being generally parallel to and spaced from the inner wall to define a cavity therebetween, the inner wall having a sheathing board attached to a plurality of studs, the laminated board being positioned between the inner and outer walls, the combination comprising:

a panel having a plurality of sockets in the panel, each of the plurality of sockets having an opening defined at a generally planar face of the panel and a depth defined by a closed end;

wherein each of the plurality of sockets is identical to each other of the plurality of sockets and the plurality of sockets are evenly spaced and arranged on the panel;

a plurality of fasteners each coupled to the generally planar face of the laminated board and the inner wall and spaced from each of the plurality of sockets;

a lath layer on the generally planar face of the panel, the plurality of fasteners each having an enlarged head securing the lath layer to the generally planar face; and at least a coating of cement covering the generally planar face of the panel and the lath layer juxtaposed to the outer wall, wherein the coating of cement covers the generally planar face of the panel and fills each of the plurality of sockets;

wherein the closed end of each of the plurality of sockets on the panel is juxtaposed to the outer face of the inner wall and selected ones of the plurality of sockets are aligned with selected ones of the plurality of studs.

18. The laminated board of claim 17 further comprising:

a plurality of the panels, wherein each panel of the plurality of the panels is coupled to an adjacent panel of the plurality of the panels by nesting selected sockets of the plurality of sockets which are proximate to a terminal edge of each adjacent panel of the plurality of the panels with each other.

* * * * *